US007908997B2

(12) United States Patent
Lessley et al.

(10) Patent No.: US 7,908,997 B2
(45) Date of Patent: Mar. 22, 2011

(54) HYBRID HOT MELT ADHESIVE OR OTHER THERMOPLASTIC MATERIAL DISPENSING SYSTEM

(75) Inventors: Mel Steven Lessley, Villa Hills, KY (US); Daniel D. Bourget, Hendersonville, TN (US)

(73) Assignee: Illinois Tool Works Inc., Glenview, IL (US)

( * ) Notice: Subject to any disclaimer, the term of this patent is extended or adjusted under 35 U.S.C. 154(b) by 819 days.

(21) Appl. No.: 11/806,792

(22) Filed: Jun. 4, 2007

(65) Prior Publication Data

US 2008/0302299 A1 Dec. 11, 2008

(51) Int. Cl.
*B05C 3/02* (2006.01)

(52) U.S. Cl. ..... 118/411; 239/266; 239/267; 239/268; 239/239; 425/7; 118/320

(58) Field of Classification Search ..... 118/320; 425/7; 239/266–268, 418
See application file for complete search history.

(56) References Cited

U.S. PATENT DOCUMENTS

| | | | | |
|---|---|---|---|---|
| 3,408,008 | A * | 10/1968 | Cocks | 239/135 |
| 3,957,177 | A * | 5/1976 | Walls | 222/318 |
| 4,682,710 | A * | 7/1987 | Turner et al. | 222/63 |
| 6,089,413 | A | 7/2000 | Riney et al. | |
| 6,171,089 | B1 | 1/2001 | Oehman, Jr. | |
| 6,220,843 | B1 * | 4/2001 | Allen | 425/7 |
| 6,422,428 | B1 | 7/2002 | Allen et al. | |
| 6,688,498 | B1 | 2/2004 | McGuffey | |
| 2003/0029552 | A1 * | 2/2003 | Parcels | 156/212 |
| 2004/0099752 | A1 | 5/2004 | Boger | |
| 2005/0242108 | A1 * | 11/2005 | Harris et al. | 222/1 |

FOREIGN PATENT DOCUMENTS

EP 0494453 7/1992

* cited by examiner

*Primary Examiner* — Parviz Hassanzadeh
*Assistant Examiner* — Albert Hilton
(74) *Attorney, Agent, or Firm* — Law Offices of Steven W. Weinpieb

(57) ABSTRACT

A new and improved hybrid hot melt adhesive or other thermoplastic material dispensing system wherein two or more different hot melt adhesive or other thermoplastic material depositions, comprising, for example, two or more different types of patterns, two or more different types of application techniques or processes, or two or more different types of cyclical operations, can effectively be simultaneously achieved at substantially two or more different locations relative to an underlying substrate. The hybrid system comprises a metering station upon which is mounted a metering head comprising a plurality of metering head dispensing modules, and a pair or remote applicator heads comprising a pair of applicator head dispensing modules.

20 Claims, 2 Drawing Sheets

HYBRID HOT MELT ADHESIVE OR OTHER THERMOPLASTIC MATERIAL DISPENSING SYSTEM

FIELD OF THE INVENTION

The present invention relates generally to hot melt adhesive or other thermoplastic material dispensing systems, and more particularly to a new and improved hybrid hot melt adhesive or other thermoplastic material dispensing system wherein two or more different hot melt adhesive or other thermoplastic material depositions, comprising, for example, two or more different types of patterns, two or more different types of application techniques or processes, or two or more different types of cyclical operations, can effectively be simultaneously achieved at substantially two or more different locations relative to an underlying substrate by means of a metering station located at a first location and upon which is mounted a metering head comprising a plurality of metering head dispensing modules, and a pair or remote applicator heads, located at a second location, comprising a pair of applicator head dispensing modules. The depositions are therefore substantially independent of each other and do not interfere with each other which is important in connection with the manufacture or fabrication of particular products or articles of manufacture.

BACKGROUND OF THE INVENTION

In connection with the dispensing of hot melt adhesive or other thermoplastic materials for various different applications in conjunction with the fabrication of different products or articles upon various different production lines, or at various different locations or regions of a particular production line, two or more different hot melt adhesive or other thermoplastic material depositions, comprising, for example, two or more different types of patterns, two or more different types of application techniques or processes, or two or more different types of cyclical operations, sometimes need to be substantially simultaneously achieved at substantially two or more different locations relative to the underlying substrate. For example, in connection with the fabrication of particular articles of manufacture, it is sometimes necessary to apply or deposit the particular materials onto the underlying article substrate in accordance with different patterns, by means of different application techniques or processes, or by means of different cyclical operations. Yet further, it is desirable that the operating or application systems be relatively simple and cost-effective. For example, for example, the two or more different hot melt adhesive or other thermoplastic material depositions could of course be achieved by means of two or totally different or separate systems, however, that would not be very cost-effective. In a similar manner, or concomitantly, the physical or operative logistics would likewise be substantially problematic.

A need therefore exists in the art for a new and improved hot melt adhesive or other thermoplastic material dispensing system wherein two or more different hot melt adhesive or other thermoplastic material depositions, comprising, for example, two or more different types of deposition patterns, two or more different types of application techniques or processes, or two or more different types of cyclical operations, can in fact effectively be simultaneously achieved at substantially two or more different locations relative to an underlying substrate, and wherein further, the overall system is relatively simple and cost-effective.

SUMMARY OF THE INVENTION

The foregoing and other objectives are achieved in accordance with the teachings and principles of the present invention through the provision of a new and improved hybrid hot melt adhesive or other thermoplastic material dispensing system which comprises a hot melt adhesive or other thermoplastic material metering station which, in turn, comprises a metering head having a plurality of applicator modules fixedly mounted thereon for dispensing or depositing first portions of a hot melt adhesive or other thermoplastic material onto a first region of an underlying substrate in accordance with a first pattern and mode of operation. In addition, one or more hot melt adhesive or other thermoplastic material conveyance modules are also fixedly mounted upon the metering head so as to convey the hot melt adhesive or other thermoplastic material, through means of suitable hose connections, to one or more applicator heads, respectively having applicator modules fixedly mounted thereon, which are located remote from the hot melt adhesive or other thermoplastic metering station, so as to dispense or deposit second portions of the hot melt adhesive or other thermoplastic material onto a second region of the underlying substrate in accordance with a second pattern or mode of operation. In this manner, two or more different hot melt adhesive or other thermoplastic material depositions, comprising, for example, two or more different types of deposition patterns, two or more different types of application techniques or processes, or two or more different types of cyclical operations, can effectively be simultaneously achieved at substantially two or more different locations relative to the underlying substrate by means of the plurality of applicator modules mounted upon the metering head and the applicator modules mounted upon the remotely located applicator heads. In addition, it is to be appreciated that both sets of applicator modules are effectively supplied with hot melt adhesive or other thermoplastic material from the same metering station which renders the overall system cost-effective as well as relatively simple from an operational or logistical point of view.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
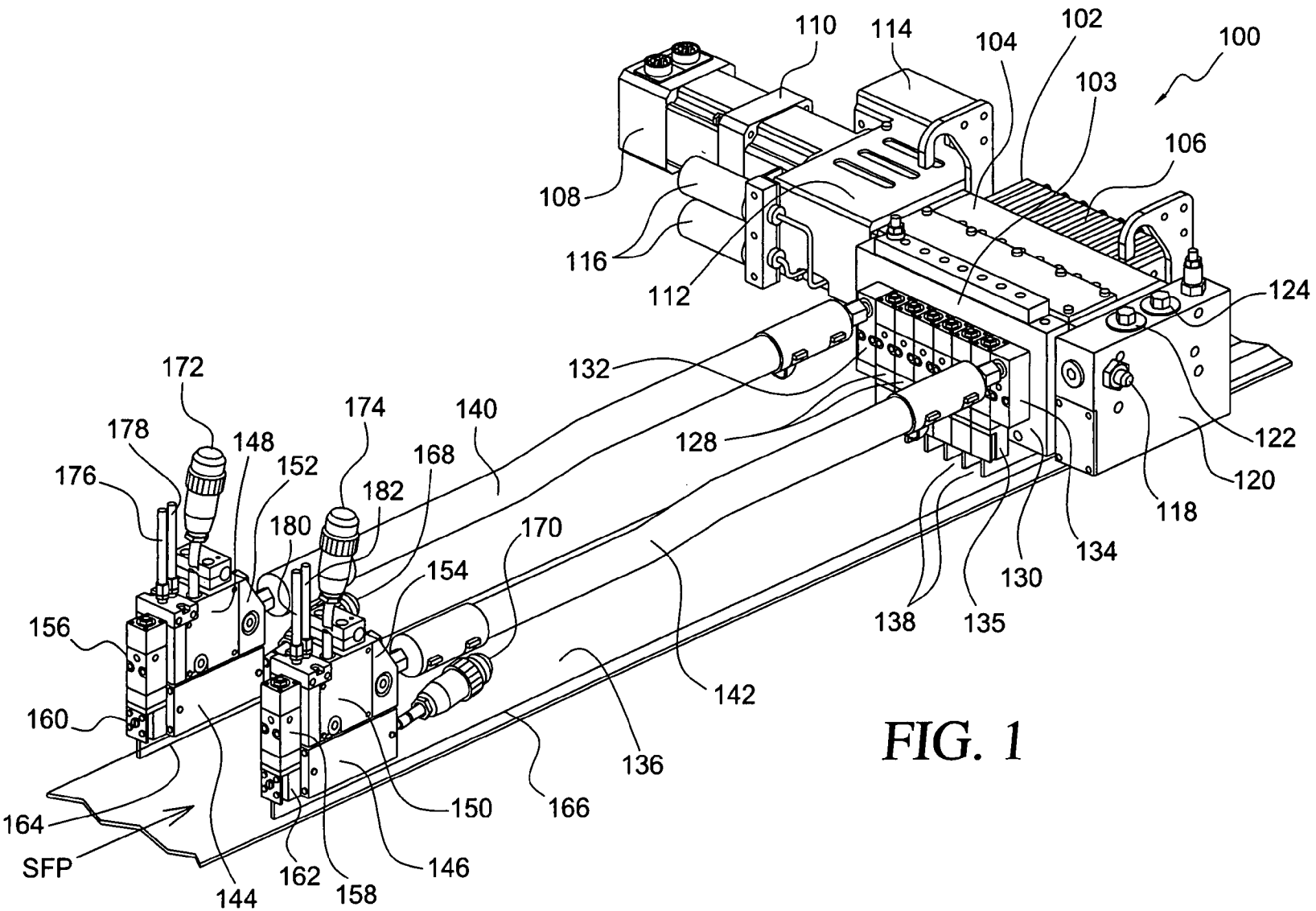
FIG. 1 is a perspective view of a new and improved hybrid hot melt adhesive or other thermoplastic material dispensing system as constructed in accordance with the principles and teachings of the present invention and showing the cooperative parts thereof.
Figure 2:
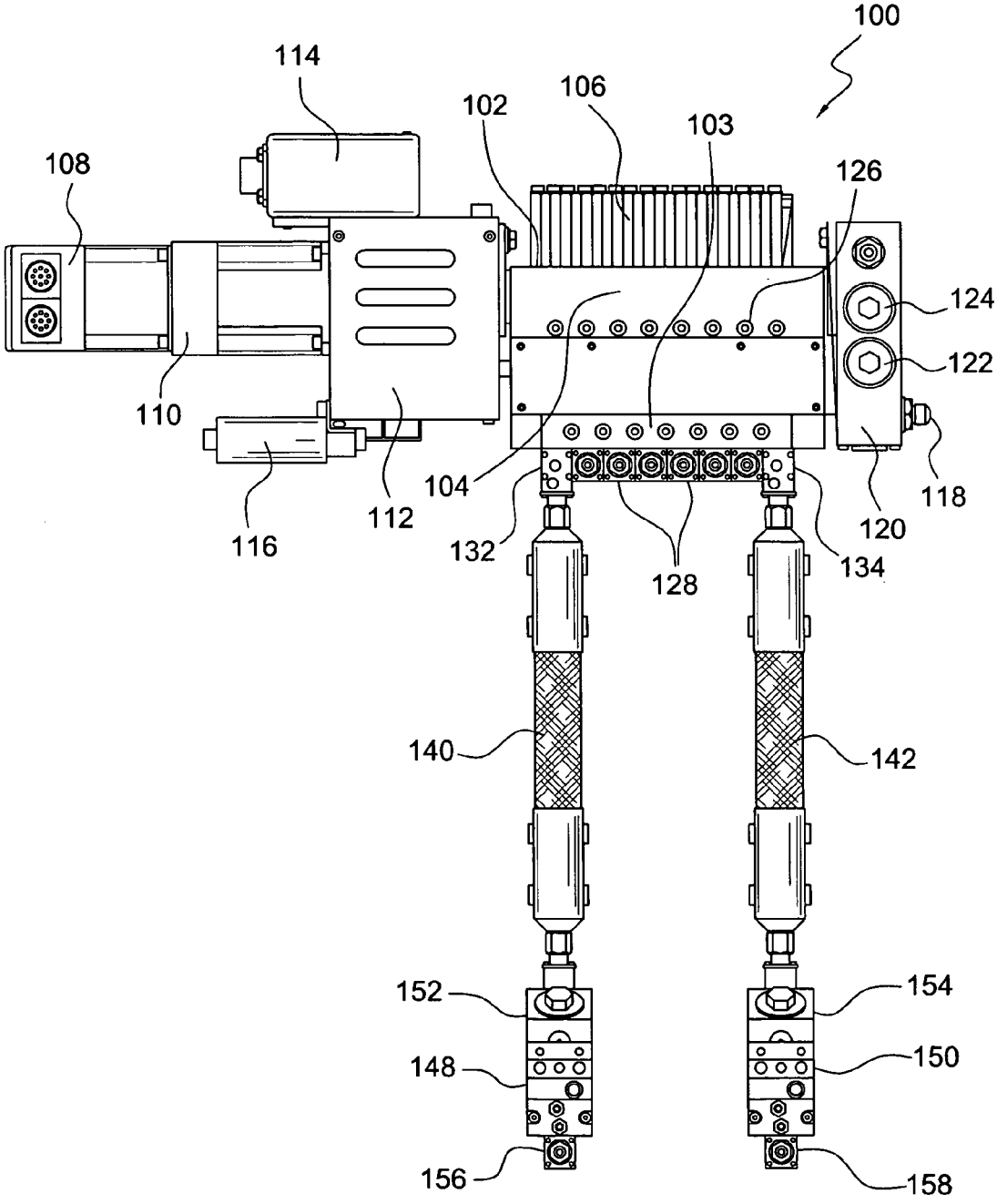
FIG. 2 is a top plan view of the new and improved hybrid hot melt adhesive or other thermoplastic material dispensing system as illustrated within FIG. 1.

Referring now to the drawings, and more particularly to FIGS. 1 and 2, a new and improved hybrid hot melt adhesive or other thermoplastic material dispensing system, constructed in accordance with the principles and teachings of the present invention, is disclosed and is generally indicated by the reference character 100. More particularly, it is seen that the new and improved hybrid hot melt adhesive material or other thermoplastic material dispensing system 100 comprises a hot melt adhesive material or other thermoplastic metering station 102 which, in turn, comprises a metering head 103 and a drive gear manifold 104 upon which a plurality of rotary, gear-type metering pump assemblies 106 are mounted so as to individually output hot melt adhesive or other thermoplastic material toward the metering head 103. While any number of rotary, gear-type metering pump assemblies 106 may be mounted upon the drive gear manifold 104, eight rotary, gear-type metering pump assemblies 106 are illustrated, it being further appreciated that each one of the rotary, gear-type metering pump assemblies 106 effectively comprises a three-piece or three-plate sandwich construction within which the various gear members, comprising each one of the rotary, gear-type metering pump assemblies 106, are disposed. Still further, a drive motor 108 is adapted to be operatively connected, through means of a gear box 110 and a coupling 32, to a drive shaft, not illustrated, which is disposed within the drive gear manifold 104 and which is adapted to be operatively connected to each one of the plurality of rotary, gear-type metering pump assemblies 106, and it is also seen that an electrical junction box 114, for providing electrical power to the drive motor 108, and a pair of pressure transducers 116 are operatively associated with the motor drive system.

An inlet port 118, is adapted to be fluidically connected by means of a suitable supply hose, not illustrated, to a remotely located adhesive supply unit (ASU), also not illustrated, whereby a supply of the hot melt adhesive or other thermoplastic material is able to be supplied to the hot melt adhesive or other thermoplastic material metering station 102 of the hot melt adhesive or other thermoplastic material dispensing system 100, and it is seen that the inlet port 118 is mounted upon a filter block 120 within which there is disposed a pair of filter assemblies 122,124. The filter block 120 is mounted upon the drive gear manifold 104, and it is also seen that a plurality of pressure monitoring devices or mechanisms 126 are disposed atop the drive gear manifold 104. A plurality of first hot melt adhesive or other thermoplastic material metering head dispensing or applicator modules 128, such as, for example, six metering head dispensing or applicator modules, are mounted upon a side wall surface portion 130 of the metering head 103 so as to effectively define a horizontal transverse array of the metering head dispensing or applicator modules 128, and a plurality of second hot melt adhesive or other thermoplastic material conveyance modules 132,134 such as, for example, two conveyance modules, are also adapted to be mounted upon the side wall surface portion 130 of the metering head 103 so as to be disposed upon opposite sides of the horizontal array of the first hot melt adhesive or other thermoplastic material metering head dispensing or applicator modules 128. All of the first hot melt adhesive or other thermoplastic material metering head dispensing or applicator modules 128, as well as the pair of second hot melt adhesive or other thermoplastic material conveyance modules 132,134, are adapted to be respectively fluidically connected to each one of the plurality of rotary, gear-type metering pump assemblies 106 through means of suitable fluid passageways, not illustrated, which are defined within the drive gear manifold 104 such that each one of the first hot melt adhesive or other thermoplastic material metering head dispensing or applicator modules 128, as well as each one of the pair of second hot melt adhesive or other thermoplastic material conveyance modules 132,134, is adapted to receive a metered supply of hot melt adhesive or other thermoplastic material from a respective one of the plurality of rotary, gear-type metering pump assemblies 106.

Continuing further, in accordance with the principles and teachings of the present invention, it is seen that the plurality of first hot melt adhesive or other thermoplastic material metering head dispensing or applicator modules 128 respectively comprise or have dispensing nozzle assemblies 135 operatively associated therewith wherein the dispensing nozzle assemblies 135 are adapted to dispense and deposit first predetermined metered amounts of the hot melt adhesive or other thermoplastic material onto an underlying substrate 136 in accordance with first predetermined techniques or processes so as to in fact deposit the first predetermined metered amounts of the hot melt adhesive or other thermoplastic material onto first predetermined, relatively central regions of the underlying substrate 136 in accordance with first predetermined patterns 138. It is to be noted that the deposition techniques or processes can be any one of a variety of non-contact spray-type techniques or processes, such as, for example, uniform fiber deposition, spiral spray, melt-blown, or curtain coat techniques or processes, or alternatively, the deposition techniques or processes can be any one of a variety of contact techniques or processes, such as, for example, standard slot die coating, bead coating, or rotary pattern coating.

Continuing still yet further, however, it is seen that unlike the plurality of first hot melt adhesive or other thermoplastic material metering head dispensing or applicator modules 128 having the aforenoted dispensing nozzles 135 operatively associated therewith, the pair of second hot melt adhesive or other thermoplastic material conveyance modules 132,134 do not have dispensing nozzle assemblies operatively associated therewith. To the contrary, each one of the pair of second hot melt adhesive or other thermoplastic material conveyance modules 132,134 is adapted to be fluidically connected to a first end portion of a hot melt adhesive or other thermoplastic material conveyance hose assembly 140,142, while a second, oppositely disposed end portion of each one of the hot melt adhesive or other thermoplastic material conveyance hose assemblies 140,142 is respectively fluidically connected to a hot melt adhesive or other thermoplastic material applicator head 144,146 through means of a hot melt adhesive or other thermoplastic material manifold 148,150 and a filter block 152,154.

The hot melt adhesive or other thermoplastic material applicator heads 144,146 respectively have hot melt adhesive or other thermoplastic material dispensing or applicator modules 156,158 fixedly mounted thereon, and respectively comprise or have dispensing nozzle assemblies 160,162 operatively associated therewith wherein the dispensing nozzle assemblies 160,162 are adapted to dispense and deposit second predetermined metered amounts of the hot melt adhesive or other thermoplastic material onto the underlying substrate 136 in accordance with second predetermined techniques or processes so as to in fact deposit the second predetermined metered amounts of the hot melt adhesive or other thermoplastic material onto second predetermined regions of the underlying substrate 136, upon lateral sides or outside of the first relatively centralized regions 138 of the underlying substrate 136, in accordance with second predetermined patterns 164,166. As was the case with the deposition techniques or processes characteristic of the dispensing nozzle assemblies 135, the deposition techniques or processes characteristic of the dispensing nozzle assemblies 160,162 can be any one of a variety of non-contact spray-type techniques or processes, such as, for example, uniform fiber deposition, spiral spray, melt-blown, or curtain coat techniques or processes, or alternatively, the deposition techniques or processes can be any one of a variety of contact techniques or processes, such as, for example, standard slot die coating, bead coating, or rotary pattern coating.

It is to be noted further that a first supply air coupling, not visible, is provided upon each one of the applicator heads 144,146 so as to respectively supply air into each applicator head 144,146 for mixture with the incoming hot melt adhesive or other thermoplastic material being supplied to each one of the applicator heads 144,146 by means of its respective hose assembly 140,142, and first electrical connectors for electrical connections to supply air pre-heater mechanisms, also not illustrated, are disclosed at 168, 170. In addition, second electrical connectors, for electrical connections to hot melt adhesive or other thermoplastic material pre-heater mechanisms, also not illustrated, are disclosed at 172,174, and second and third sets of air couplings 176,178 and 180, 182 are provided for conducting control air into the hot melt adhesive or other thermoplastic material manifolds 148,150 in order to control the disposition of the hot melt adhesive or other thermoplastic material dispensing control valve mechanisms, not illustrated but respectively disposed within the hot melt adhesive or other thermoplastic material manifolds 148, 150, for controlling the dispensing of the hot melt adhesive or other thermoplastic material to the output or dispensing nozzle assemblies 160, 162.

Having described substantially all of the structural components comprising the new and improved hybrid hot melt adhesive or other thermoplastic material dispensing system 100 of the present invention, as constructed and operatively interengaged with each other in accordance with the principles and teachings of the present invention, the practical and operational significance and advantages of the new and improved hybrid hot melt adhesive or other thermoplastic material dispensing system 100 of the present invention will now be discussed. More particularly, for example, it is to be appreciated that in accordance with the principles and teachings of the present invention, two different types of hot melt adhesive or other thermoplastic material depositions onto the underlying substrate 136 can be achieved at or upon two different locations or regions of the underlying substrate 136 by means of, for example, the first set of hot melt adhesive or other thermoplastic material metering head dispensing or applicator modules 128 and their dispensing nozzle assemblies 135, and the second set of hot melt adhesive or other thermoplastic material applicator head dispensing or applicator modules 156,158 and their dispensing nozzle assemblies 160,162 which are located at positions or locations remote from, and upstream of, the first set of hot melt adhesive or other thermoplastic material metering head dispensing or applicator modules 128 and their dispensing nozzle assemblies 135 as considered in the direction of movement of the underlying substrate 136 along the substrate flow path SFP.

As has been noted hereinbefore, the deposition processes or techniques of either one of the sets of dispensing nozzle assemblies 135, or of the dispensing nozzle assemblies 160, 162 can be any one of the variety of non-contact spray-type techniques or processes, such as, for example, uniform fiber deposition, spiral spray, melt-blown, or curtain coat techniques or processes, or alternatively, the deposition techniques or processes can be any one of a variety of contact techniques or processes, such as, for example, standard slot die coating, bead coating, or rotary pattern coating. It is therefore to be appreciated that two or more different hot melt adhesive or other thermoplastic material depositions, comprising, for example, two or more different types of deposition patterns, two or more different types of application techniques or processes, or two or more different types of cyclical operations, can effectively be simultaneously and independently achieved at substantially two or more different locations relative to the underlying substrate 136 by means of the plurality of applicator modules 128 and their dispensing nozzle assemblies 135 mounted upon the metering head 103, and the applicator modules 156,158 and their dispensing nozzle assemblies 160,162 mounted upon the remotely located applicator heads 144,146.

In addition, it is to be appreciated that while the aforenoted substrate deposition results comprising, for example, the two or more different hot melt adhesive or other thermoplastic material depositions encompassing the two or more different types of deposition patterns, the two or more different types of application techniques or processes, or the two or more different types of cyclic operations, could effectively be otherwise simultaneously and independently achieved at the substantially two or more different locations relative to the underlying substrate 136 by, for example, a first set of metering head applicator modules and metering head dispensing nozzle assemblies similar to the plurality of metering head applicator modules 128 and the metering head dispensing nozzle assemblies 135 mounted upon the metering head 103, and a second set of remotely located metering head applicator modules and metering head dispensing nozzle assemblies in lieu of the applicator modules 156,158 and their dispensing nozzle assemblies 160,162 mounted upon the remotely located applicator heads 144,146, such a system would be extremely costly and logistically problematic in view of the fact that separate metering stations, similar to metering station 102, would have to be disposed or positioned at each location at which one would want to achieve a particular independent deposition pattern, application technique or process, or cyclical operation. Accordingly, multiple motor drives, multiple sets of rotary, gear-type metering pump assemblies, multiple metering heads, and the like, would be required.

To the contrary, however, in accordance with the new and improved hybrid hot melt adhesive or other thermoplastic material dispensing system 100 as constructed in accordance with the principles and teachings of the present invention, only the one metering station 102 is necessary for the supply of the hot melt adhesive or other thermoplastic material to both of the aforenoted first set of hot melt adhesive or other thermoplastic material metering head dispensing or applicator modules 128 and their dispensing nozzle assemblies 135, and the second set of hot melt adhesive or other thermoplastic material applicator head dispensing or applicator modules 156,158 and their dispensing nozzle assemblies 160,162 which are located at positions or locations remote from, and upstream of, the first set of hot melt adhesive or other thermoplastic material metering head dispensing or applicator modules 128 and their dispensing nozzle assemblies 135 as considered in the direction of movement of the underlying substrate 136 along the substrate flow path SFP. Accordingly, the overall hybrid system is effectively rendered quite cost-effective as well as relatively simple from an operational or logistical point of view.

Furthermore, it is also to be noted that as a result of locating the second set of hot melt adhesive or other thermoplastic material applicator head dispensing or applicator modules 156,158 and their dispensing nozzle assemblies 160,162 at positions or locations which are remote from and upstream of the first set of hot melt adhesive or other thermoplastic material metering head dispensing or applicator modules 128 and their dispensing nozzle assemblies 135, as considered in the direction of movement of the underlying substrate 136 along the substrate flow path SFP, the particular deposition patterns, for example, dispensed from the second set of hot melt adhesive or other thermoplastic material applicator head dispensing or applicator modules 156,158 and their dispensing nozzle assemblies 160,162 will not interfere with the particular deposition patterns, for example, which are dispensed from the first set of hot melt adhesive or other thermoplastic material metering head dispensing or applicator modules 128 and their dispensing nozzle assemblies 135. In addition, the re-verse also holds true, that is, the particular deposition patterns dispensed from the first set of hot melt adhesive or other thermoplastic material metering head dispensing or applicator modules 128 and their dispensing nozzle assemblies 135 will not interfere with the particular deposition patterns which are dispensed from the second set of hot melt adhesive or other thermoplastic material applicator head dispensing or applicator modules 156,158 and their dispensing nozzle assemblies 160,162.

Still further, it is to be noted that, in accordance with the particular structural requirements or characteristics of particular products or articles of manufacture, the first set of hot melt adhesive or other thermoplastic material metering head dispensing or applicator modules 128 and their dispensing nozzle assemblies 135 may necessarily be activated or run in accordance with different modes of operation than the second set of hot melt adhesive or other thermoplastic material applicator head dispensing or applicator modules 156,158 and their dispensing nozzle assemblies 160, 162. For example, the first set of hot melt adhesive or other thermoplastic material metering head dispensing or applicator modules 128 and their dispensing nozzle assemblies 135 may be activated or run substantially continuously throughout the production or fabrication of a particular product or article of manufacture, whereas the second set of hot melt adhesive or other thermoplastic material applicator head dispensing or applicator modules 156,158 and their dispensing nozzle assemblies 160, 162 may be run substantially intermittently. In conjunction with such production line operations, it is noted that the hose assemblies 140,142 may be flexible or rigid, heated or non-heated, depending upon the particular material being conveyed for dispensing and deposition, and may have length dimensions anywhere within a range, for example, of 50 mm to 25 meters. It is to be lastly appreciated that by incorporating the hose assemblies 140,142 into the aforenoted hybrid system 100, the hose assemblies 140,142 will effectively serve as fluid accumulators whereby the hot melt adhesive or other thermoplastic material, being outputted by means of the particular ones of the rotary, gear-type metering pump assemblies 106 fluidically connected to the hot melt adhesive or other thermoplastic material conveyance modules 132,134, will always be available to the hot melt adhesive or other thermoplastic material applicator head dispensing or applicator modules 156,158 and their dispensing nozzle assemblies 160,162 in the desired amounts and at requisite supply pressures.

Thus, it may be seen that in accordance with the teachings and principles of the present invention, there has been provided a new and improved hybrid hot melt adhesive or other thermoplastic material dispensing system which comprises a hot melt adhesive or other thermoplastic material metering station which, in turn, comprises a metering head having a plurality of applicator modules fixedly mounted thereon for dispensing or depositing a first hot melt adhesive or other thermoplastic material onto a first region of an underlying substrate in accordance with a first pattern and mode of operation. In addition, one or more hot melt adhesive or other thermoplastic material conveyance modules are also fixedly mounted upon the metering head so as to convey the hot melt adhesive or other thermoplastic material, through means of suitable hose connections, to one or more applicator heads, respectively having applicator modules fixedly mounted thereon, which are located remote from the hot melt adhesive or other thermoplastic metering station, so as to dispense or deposit a second hot melt adhesive or other thermoplastic material onto a second region of the underlying substrate in accordance with a second pattern or mode of operation. In this manner, two or more different hot melt adhesive or other thermoplastic material depositions, comprising, for example, two or more different types of deposition patterns, two or more different types of application techniques or processes, or two or more different types of cyclical operations, can effectively be simultaneously achieved at substantially two or more different locations relative to the underlying substrate by means of the plurality of applicator modules mounted upon the metering head and the applicator modules mounted upon the remotely located applicator heads. It is also to be appreciated that both sets of applicator modules are effectively supplied with hot melt adhesive or other thermoplastic material from the same metering station which renders the overall system cost-effective as well as relatively simple from an operational or logistical point of view.

Obviously, many variations and modifications of the present invention are possible in light of the above teachings. It is noted, for example, that while the disclosure has been directed toward the deposition of hot melt adhesive or other thermoplastic materials, the disclosed hybrid dispensing system can likewise be utilized to dispense other fluids, comprising, for example, non-thermoplastic materials. It is therefore to be understood that within the scope of the appended claims, the present invention may be practiced otherwise than as specifically described herein.

What is claimed as new and desired to be protected by Letters Patent of the United States of America, is:

1. A hybrid dispensing system for dispensing and depositing two fluid depositions onto two longitudinally spaced regions of a substrate moving along a longitudinally extending flow path with respect to said hybrid dispensing system, comprising:

a longitudinally extending flow path along which a substrate, upon which fluid depositions are to be deposited, is adapted to be moved;

a metering applicator disposed at a first location defined along said longitudinally extending substrate flow path;

a fluid inlet mounted upon said metering applicator for supplying a fluid, to be deposited onto the substrate, to said metering applicator;

a plurality of pumps disposed upon said metering applicator for independently outputting a plurality of fluid flows;

a single motor drive for driving all of said plurality of pumps;

at least one first applicator module, mounted upon said metering applicator disposed at said first location defined along said longitudinally extending substrate flow path, fluidically connected to a first one of said plurality of pumps disposed upon said metering applicator so as to receive a first one of said plurality of fluid flows from said first one of said plurality of pumps, and having a first dispensing nozzle disposed thereon for dispensing a first fluid deposition onto a first region of the substrate at said first location;

at least one second applicator module, disposed at a second location defined along said longitudinally extending substrate flow path which is longitudinally remote from said first location along said longitudinally extending substrate flow path at which said metering applicator, and said at least one first applicator module mounted upon said metering applicator, is disposed, fluidically connected to a second one of said plurality of pumps disposed upon said metering applicator so as to receive a second one of said plurality of fluid flows from said second one of said plurality of pumps, and having a second dispensing nozzle disposed thereon for dispensing a second fluid deposition onto a second region of the substrate which is located at said second location remote from the first region of the substrate onto which said first fluid deposition from said at least one first applicator module and said first dispensing nozzle was deposited; and at least one conduit fluidically connecting said at least one second applicator module and said second dispensing nozzle, located at said second location remote from said metering applicator, said at least one first applicator module, and said first dispensing nozzle mounted upon said metering applicator, so as to provide said at least one second applicator module and said second dispensing nozzle with said second one of said plurality of fluid flows from said second one of said plurality of pumps of said metering applicator, whereby said hybrid system can deposit said first and second fluid depositions onto two longitudinally spaced regions of the substrate which are remote from each other.

2. The hybrid dispensing system as set forth in claim 1, wherein:

said at least one first applicator module mounted upon said metering applicator comprises a plurality of first applicator modules and first dispensing nozzles disposed within a transverse array with respect to said longitudinally extending flow path along which the substrate is adapted to be moved.

3. The hybrid dispensing system as set forth in claim 2, wherein:

said plurality of first applicator modules and first dispensing nozzles disposed within said transverse array comprise six first applicator modules and six first dispensing nozzles.

4. The hybrid dispensing system as set forth in claim 2, further comprising:

at least one adaptor module mounted upon said metering applicator so as to fluidically interconnect said metering applicator to said at least one conduit.

5. The hybrid dispensing system as set forth in claim 4, wherein:

said at least one second applicator module comprises a plurality of second applicator modules comprising a plurality of second dispensing modules respectively having a plurality of second dispensing nozzles disposed therein;

said at least one conduit comprises a plurality of conduits; and said at least one adaptor module comprises a plurality of adaptor modules.

6. The hybrid dispensing system as set forth in claim 5, wherein:

said plurality of second applicator modules and said plurality of second dispensing modules comprises a pair of second applicator modules and a pair of second dispensing modules;

said plurality of conduits comprises a pair of conduits; and said plurality of adaptor modules comprises a pair of adaptor modules.

7. The hybrid dispensing system as set forth in claim 1, wherein:

said at least one conduit, fluidically connecting said metering applicator to said at least one second applicator module located remote from said metering applicator so as to provide said at least one second applicator module with a second one of said plurality of fluid flows from a second one of said plurality of pumps of said metering applicator, comprises at least one hose member.

8. The hybrid dispensing system as set forth in claim 7, wherein:

said at least one hose member comprises a pair of hose members.

9. The hybrid dispensing system as set forth in claim 5, wherein:

said pair of adaptor modules mounted upon said metering applicator are disposed upon opposite ends of said transverse array of said plurality of first applicator modules.

10. The hybrid dispensing system as set forth in claim 9, wherein:

said plurality of first applicator modules, comprising said plurality of first dispensing nozzles, will dispense said first fluid depositions upon an axially central portion of the substrate; and said plurality of second applicator modules, comprising said plurality of second dispensing nozzles, will dispense said second fluid depositions onto regions of the substrate which are laterally outside of said axially central portion of the substrate.

11. The hybrid dispensing system as set forth in claim 1, wherein:

said first and second fluid depositions comprise two different deposition patterns.

12. The hybrid dispensing system as set forth in claim 1, wherein:

said first and second fluid depositions comprise two different application techniques.

13. The hybrid dispensing system as set forth in claim 1, wherein:

said first and second fluid depositions comprise two different application processes.

14. The hybrid dispensing system as set forth in claim 1, wherein:

said first and second fluid depositions comprise two different cyclical operations.

15. The hybrid dispensing system as set forth in claim 12, wherein:

said first and second deposition techniques are selected from the group comprising non-contact spray techniques and contact spray techniques.

16. The hybrid dispensing system as set forth in claim 15, wherein:

said non-contact spray techniques are selected from the group comprising uniform fiber deposition, spiral spray, melt-blown, and curtain coat techniques.

17. The hybrid dispensing system as set forth in claim 15, wherein:

said contact techniques are selected from the group comprising standard slot die coating, bead coating, and rotary pattern coating.

18. The hybrid dispensing system as set forth in claim 14, wherein:

said two different cyclical operations comprise continuous and intermittent.

19. The hybrid dispensing system as set forth in claim 1, wherein:

said fluid to be dispensed comprises a thermoplastic material.

20. The hybrid dispensing system as set forth in claim 19, wherein:

said thermoplastic material comprises hot melt adhesive.

* * * * *